US005628657A

United States Patent [19]

Breivik et al.

[11] Patent Number: 5,628,657

[45] Date of Patent: May 13, 1997

[54] LOADING/UNLOADING BUOY

[75] Inventors: Kare Breivik, Tau; Arne Smedal, Farvik; Kare Syvertsen, Arendal, all of Norway

[73] Assignee: Den Norske Stats Oljeselskap A.S., Stavanger, Norway

[21] Appl. No.: 331,528

[22] PCT Filed: Apr. 29, 1993

[86] PCT No.: PCT/NO93/00070

§ 371 Date: Jan. 13, 1995

§ 102(e) Date: Jan. 13, 1995

[87] PCT Pub. No.: WO93/22190

PCT Pub. Date: Nov. 11, 1993

[30] Foreign Application Priority Data

Apr. 30, 1992 [NO] Norway ..... 921704

[51] Int. Cl.[6] ..... B63B 21/00

[52] U.S. Cl. ..... 441/5; 114/230

[58] Field of Search ..... 114/230; 441/3–5

[56] References Cited

U.S. PATENT DOCUMENTS 3,735,435 5/1973 Mikulicic et al. ..... 441/5

3,742,536 7/1973 Sada et al. ..... 441/5

4,490,121 12/1984 Coppens et al. ..... 441/5

4,604,961 8/1986 Ortloff et al. ..... 441/5

*Primary Examiner*—Stephen Avila

*Attorney, Agent, or Firm*—Jon Carl Gealow

[57] ABSTRACT

A buoy for use in loading or unloading of a flowable medium, especially oil, comprising an outer buoyancy member (2) arranged to be introduced and secured in a submerged downwardly open receiving space in a floating vessel, and a central member (3) which is rotatably mounted in the outer member and is intended for anchoring to the sea bed and arranged for passage of medium between a transfer line (57) which, in operation, is coupled to the lower end of the central member (3) and a tube system on the vessel. The central member (3) is provided with a lower extension body (8) having an outer peripheral portion (9) abutting on and essentially corresponding to the outer periphery of the adjacent end (10) of the outer buoyancy member (2), and having a lower portion (11) which is downwardly tapering from the outer peripheral portion (9). A number of fastening means (12) for fastening of the upper ends of anchoring lines (13) for anchoring of the buoy (1) are fastened at intervals along the periphery of the outer peripheral portion (9) of the extension body (8), and the extension body (8) comprises at least one buoyancy chamber (56) for buoyancy or ballast material.

10 Claims, 3 Drawing Sheets

LOADING/UNLOADING BUOY

BACKGROUND OF THE INVENTION

1. Field of the Invention

The present invention relates to a buoy for use in loading or unloading of a flowable medium, especially oil, comprising an outer buoyancy member arranged to be introduced and secured in a submerged downwardly open receiving space in a floating vessel, and a central member rotatably mounted in the outer member, which central member is intended for anchoring to the sea bed and is arranged for passage of medium between a transfer line which, in operation, is coupled to the lower end of the central member and a tube system on the vessel.

2. Background Information

A buoy of the above-mentioned type is disclosed in the international patent application No. PCT/NO92/00056. With the buoy according to this prior application, the floating vessel, when the buoy is placed in the receiving space thereof, is rigidly attached to the outer buoyancy member of the buoy and is rotatable about the central member which is anchored to the sea bed by means of a suitable anchoring system, and the buoy itself thus constitutes a rotating body (turret). When connecting the buoy, this is pulled up into the receiving space of the vessel by a winch means on the vessel and an associated pick-up line which is connected to the submerged buoy to carry out the pulling. Thereafter the buoy is secured by means of a locking mechanism in the receiving space.

This buoy structure entails a number of substantial advantageous in relation To previously known buoy loading systems. Thus, connection and disconnection between vessel and buoy can be carried out in a simple and quick manner, even in bad weather with relatively high waves. Further, the buoy may remain connected to the vessel in all weathers, a quick disconnection being able to be carried out if a weather limitation should be exceeded.

The buoy according to the prior application broadly has a flat underside, something which results in that the buoy becomes more movement sensitive than necessary, under the influence of wave and current forces in the water. Said buoy shape also results in that the fastening points for the transfer line and for the anchoring lines of the buoy are located adjacent to the flat underside of the buoy, something which has appeared to be less favourable in practice.

SUMMARY OF THE INVENTION

Thus, it is an object of the invention to provide a buoy of the stated type which has improved hydrodynamic and hydrostatic properties, and which is simultaneously designed such that the fastening point for the transfer line, and preferably also the fastening points for the anchor lines, are lowered to a lower level in relation to the outer buoyancy member of the buoy.

Another object of the invention is to provide a buoy structure giving the possibility for arrangement of one or more buoyancy chambers in the central member of the buoy, in addition to buoyancy chambers in the outer buoyancy member of the buoy.

For the achievement of the above-mentioned objects there is provided a buoy of the introductorily stated type which, according to the invention, is characterized in that the central member is provided with a lower extension body having an outer peripheral portion abutting on and essentially corresponding to the outer periphery of the adjacent end of the outer buoyancy member, and having a lower portion which is downwardly tapering from the outer peripheral portion.

In that the central member of the buoy has a lower extension body which is shaped in the stated manner, there is obtained a hydrodynamic shape resulting in less movement of the buoy in the water, because of waves and underwater currents, both when the submerged buoy is located at the lowest level, and during the connecting phase, and in addition there is achieved that the buoy more easily falls out and is released from the receiving space when disconnecting the buoy.

In an advantageous embodiment of the buoy according to the invention a number of fastening means for securing the upper ends of anchoring lines for the anchoring of the buoy are fastened at intervals along the periphery of the outer peripheral portion of the extension body. In that the fastening points for the anchor lines are fastened to the outer periphery of the buoy, direct access from the surface is achieved, so that inspection, maintenance and replacement are simplified.

According to another advantageous embodiment, the extension body comprises at least one buoyancy chamber for buoyancy or ballast material, and the buoyancy chamber or chambers preferably is/are arranged to be able to be filled or emptied, so that the buoyancy may be varied according to requirement. Auxiliary buoyancy will also be able to be introduced, so that the buoy may be brought up to the surface without any need for a pick-up line.

BRIEF DESCRIPTION OF THE DRAWINGS

The invention will be further described below in connection with an exemplary embodiment with reference to the drawings.

DESCRIPTION OF THE PREFERRED EMBODIMENT

The buoy loading system in which the buoy according to the invention is intended to the be used, is described in the international patent application No. PCT/NO92/00054 which corresponds to U.S. patent application Ser. No. 08/244,440, filed Aug. 8, 1994, and reference is made to said application for a further description of this system. The fundamental construction and operation of the buoy correspond to what is disclosed in the aforementioned international application No. PCT/NO92/0005 which corresponds to U.S. patent application Ser. No. 08/244,440, filed Aug. 8, 1994, and reference is made to this application for a description of details in this of connection. The following description therefore largely will be limited to a description of the differences in relation to the buoy according to the prior application.

Figure 1:
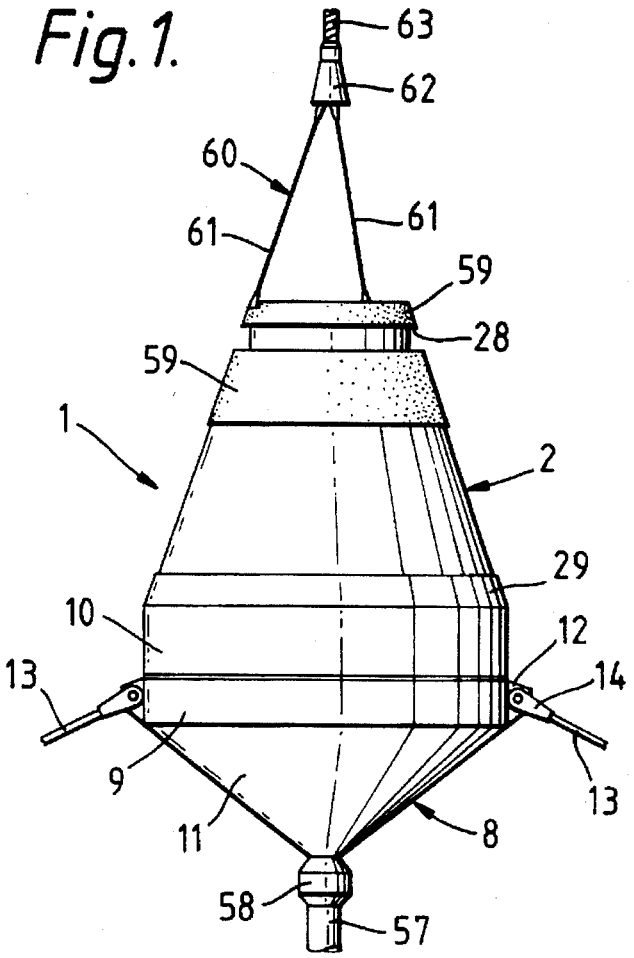
FIG. 1 shows a side view of a buoy according to the invention.
Figure 2:
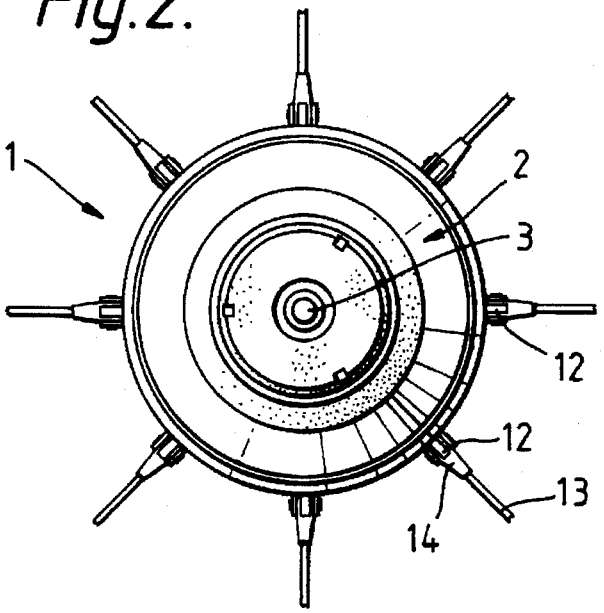
FIG. 2 shows a plan view of the buoy in FIG. 1.
Figure 3:
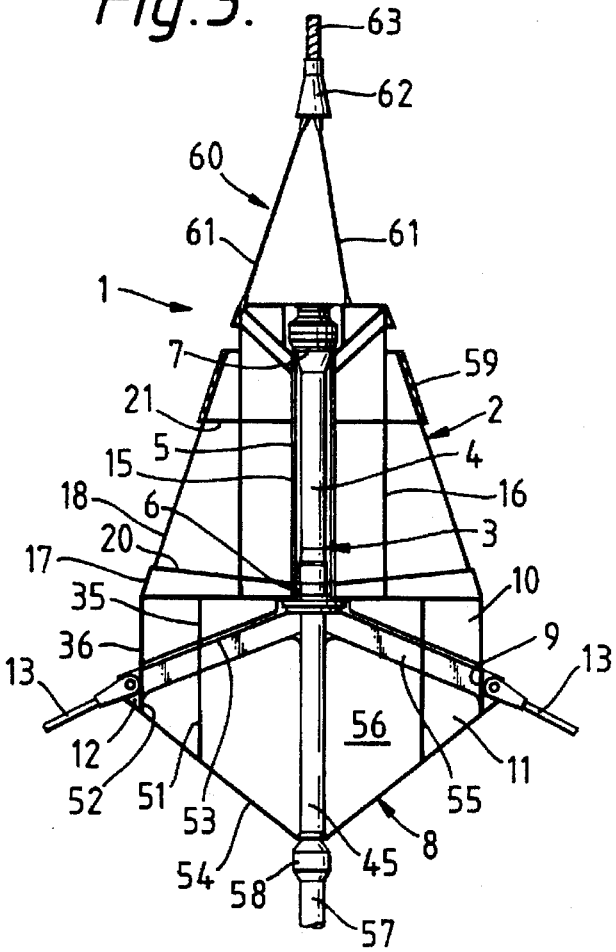
FIG. 3 shows a partly longitudinally sectioned view of the buoy in FIG. 1.

The buoy 1 shown in FIGS. 1–3 comprises an outer buoyancy member 2 and a central member 3 which is rotatably mounted in a central, longitudinally extending opening in the outer member. As appears from FIGS. 1 and 2, the buoy in the shown embodiment has a circular peripheral shape, and the outer buoyancy member 2 has an upwardly tapering conical shape.

Figure 5:
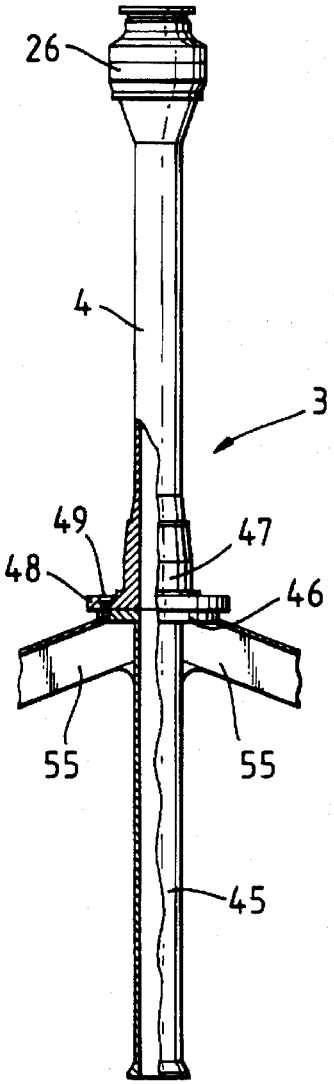
FIG. 5 shows a partial side view, partly in section and on an enlarged scale, of the central member of the buoy.
Figure 4:
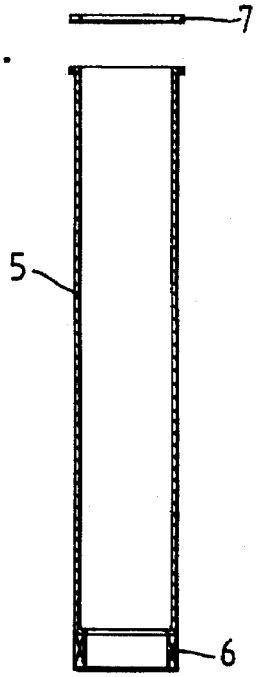
FIG. 4 shows an enlarged side view of a bearing support member in the buoy.
Figure 6:
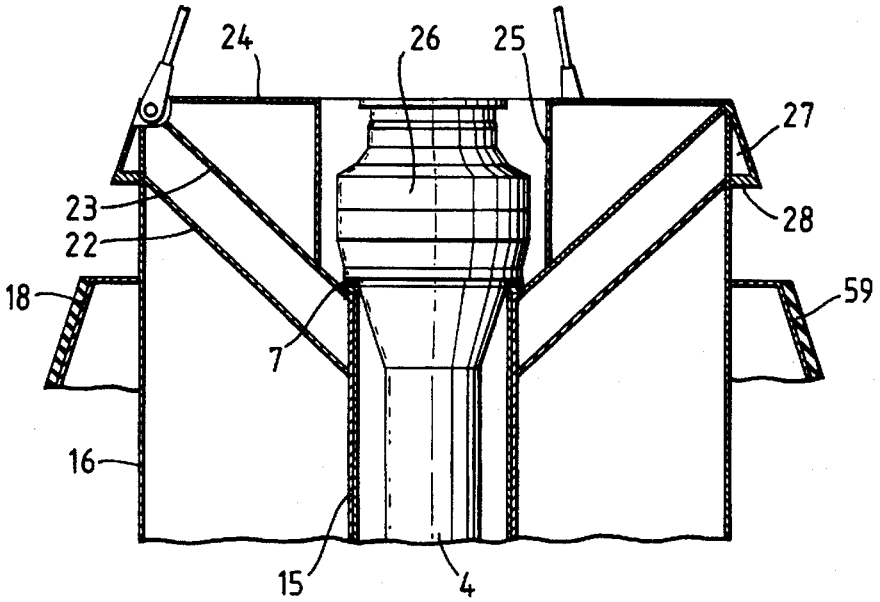
FIG. 6 shows a partly sectioned side view, on a further enlarged scale, of the details of the buoy structure according to FIG. 3.
Figure 6:
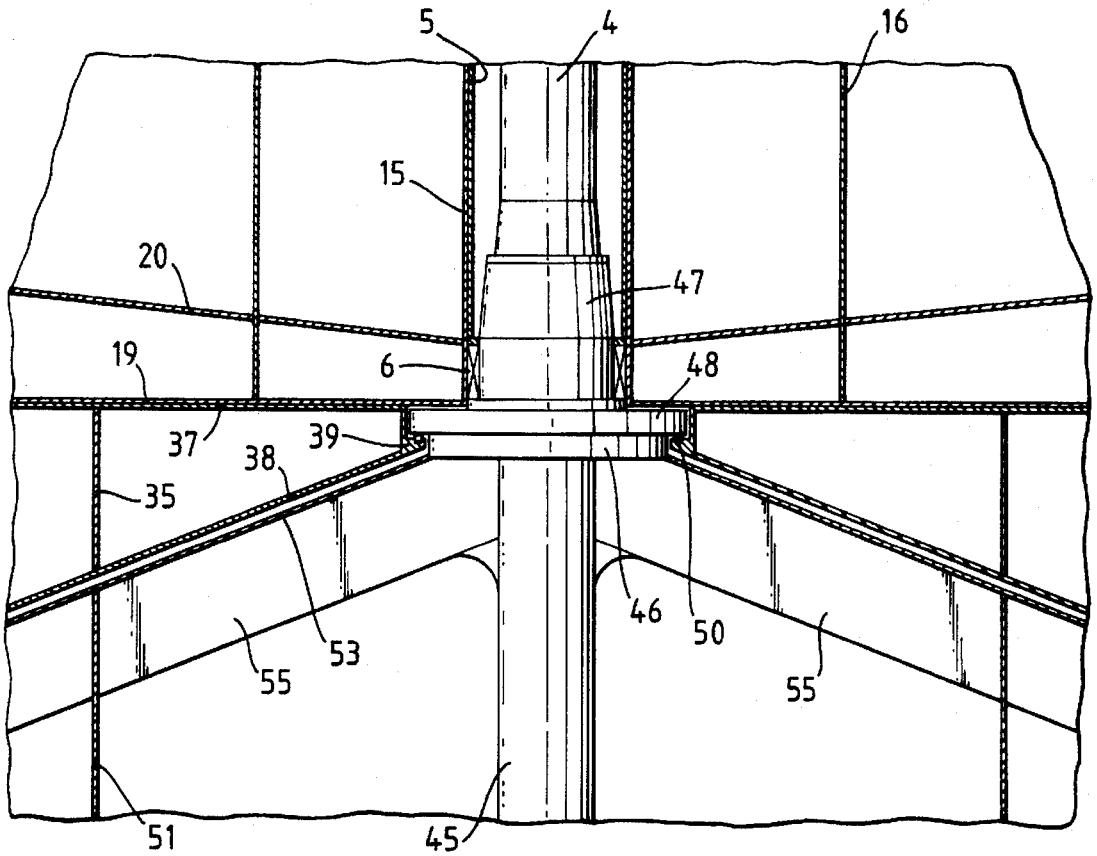

The design of the central member 3 is shown more in detail in the sectional view in FIG. 3 and in the enlarged views in FIGS. 5 and 6. The central member comprises a hollow shaft or stem member 4 which is mounted in the outer member 2 by means of a replaceable bearing support member 5 carrying a lower radial bearing 6 and an upper axial bearing 7. When required, the bearing support member 5 may be lifted up from the outer member 2 for inspection and possible replacement of parts (see FIG. 4), in principle in a corresponding manner to that of the buoy according to the aforementioned application. Further, the central member is provided with a lower extension body 8 having an outer peripheral portion 9 bordering on and shaped in accordance with the outer periphery of the adjacent end portion 10 of the outer member 2, and having a lower portion 11 which is downwardly conically tapering from the outer peripheral portion 9.

A number of fastening means 12 for securing of the upper ends of anchoring lines 13 for anchoring of the buoy are fastened at equal angular intervals along the periphery of the peripheral portion 9 of the extension body 8. In the illustrated case there are shown eight such fastening means in the form of lugs 12 having holes for receiving bolts for the fastening connection members 14 at the ends of a corresponding number of anchoring lines 13.

The outer buoyancy member 2 as well as the extension body 8 are constructed from sheet or plate elements, as shown in FIGS. 3 and 6. Thus, the outer member 2 in the illustrated embodiment comprises an inner plate cylinder 15 surrounding the bearing support member 5, an outer plate cylinder 16 which is coaxial with the inner plate cylinder 15, outer truncated-cone-shaped plate members 17, 18, and transversely extending plate elements 19, 20, 21 arranged between the first-mentioned plate elements and connected thereto by welding. In its upper portion the outer member 2 further comprises a pair of truncated-cone-shaped plate members 22, 23 which, at their inner periphery, are fastened to the inner plate cylinder 15 and at their outer periphery are fastened to the upper end portion of the outer plate cylinder 16. An upper annular plate 24 forms the top surface of the outer member 2, and a plate cylinder 25 defines a space for the receipt of a per se known spherical join 26 which is mounted at the top of the stem member 4 and forms a flexible transition to a swivel means (not shown) for connection to the tube system on the vessel where the buoy in operation is connected, as described in the aforementioned application.

To the upper portion of the plate cylinder 16 there is also fastened a ring or annular element 27 forming a collar having a downwards facing abutment edge 28 for engagement with locking elements forming part of a locking mechanism which will be arranged in the receiving space on the vessel in question, for releasable locking of the outer member of the buoy in the receiving space, as described in the aforementioned application.

By means of the described plate arrangement, the outer member 2 is divided into a number of chambers which, in a manner not further shown, may be arranged to be filled with or emptied of buoyancy or ballast material according to requirement. It will be clear that the described arrangement only represents an example, and that the construction may be varied in many different ways.

The lower portion of the outer buoyancy member 2 forms a cone member 29 which is constructed to be able to transfer the occurring horizontal forces from the anchor lines 13 to the vessel hull in question. For this purpose there may be arranged strengthening elements in the form of e.g. a number radially extending beams or plates (not further shown).

At its upper end the outer buoyancy member is also provided with an extension portion constituted by the above-mentioned end portion 10. This portion essentially is formed from a pair of concentric plate cylinders 35, 36 which are fastened by welding to an annular top plate 37 and a lower truncated-cone-shaped plate 38. At the central opening of the truncated-cone-shaped plate 38 there is arranged an annular carrier flange 39 for supporting the central member 3 when required, as described below.

In the illustrated embodiment, the extension body 8 of the central member comprises a lower hollow stem member 45 constituting an extension of and being fastened to the upper stem member 4 through a flange element 46 and a hub element 47 which is connected thereto and is adapted to receive the radial bearing 6. For assembly purposes the flange element 46 comprises a flange ring 48 which is fastened to the flange element by a number of screws 49, as suggested in FIG. 5. The flange element 46 with the flange ring 48 are arranged to support and retain the entire central member 3 when the bearing support member 5 with the bearing 6 is removed from the buoy. The flange ring 48 then is supported by the above-mentioned carrier flange 39, and the sealing ring 50 shown in FIG. 6 prevents that surrounding water in this situation penetrates between the carrier flange and the flange ring.

Further, the extension body 8 is constructed from an inner plate cylinder 51 and an outer plate cylinder 52 coaxial therewith, an upper truncated-cone-shaped plate member 53 extending parallel with the plate member 38, and a lower truncated-cone-shaped plate member 54 consequently forming the downwardly conically tapering portion 11 of the extension body. These plate elements are connected to each other by welding. Further, the extension body is stiffened by means of a number of radially extending plate elements 55 which are welded to an upper portion of the lower stem member 45 and to the flange element 46.

The described plate arrangement divides the extension body 8 in several water-tight chambers, e.g. 56 in FIG. 3, for the receipt of buoyancy or ballast material. These chambers may be provided with suitable means (not shown) to be filled with or emptied of buoyancy or ballast material as required. For example, there may be arranged suitable valves or cocks for filling or discharge of air or water. The extension body may be additionally segmented, for example by means of radially and axially extending plates, for division into additional mutually separated chambers, to ensure a desired buoyancy also if a leakage should occur in one or more of the chambers.

The lower end of the lower stem member 45 is adapted for connection to the transfer line 57 of the buoy 1, which line suitably may be connected to the buoy through a flexible joint 58, as shown in FIGS. 1 and 3.

As best shown in FIG. 1, the outer buoyancy member 2 of the buoy in its upper portion is provided with a fender means 59. This consists of a layer of an elastic material which, in the area in question, is applied to the surface of the outer member. A suitable material is rubber which may be applied by vulcanization. By means of such a fender means the buoy is protected against possible damage in connection with introduction of The buoy into the receiving space in the vessel in question.

The fender means may be designed in different ways and may e.g. comprise a number of longitudinally extending guiding edge elements (not shown) which are placed at suitable intervals along the periphery of the surface of the outer member, and which are covered by a possibly replaceable fender-forming material. By the use of such guiding edge elements having a suitable strength, the outer plate element 18 possibly may be omitted, the buoyancy material being able to consist of a suitable foam plastic or cast Glass fibre material which is reinforced by said edge elements.

As further shown in FIGS. 1 and 3, and in a corresponding manner to that shown in the aforementioned international application No. PCT/NO92/00056, the buoy 1 is provided with a so-called lifting bridle 60 which is fastened to the upper part of the buoy and consists of a number of lines 61 (three lines in the shown case) forming a cone contour forming an upper extension of the conical shape of the buoy. At its upper end The lifting bridle 60 is connected through a yoke 62 to a pick-up line 63 for hoisting and introduction into the receiving space of the vessel. This arrangement is advantageous for contributing to introduction of the buoy into the receiving space in a safe and correct manner.

We claim:

1. A buoy for use in loading or unloading of a flowable medium, especially oil, comprising an outer buoyancy member arranged to be introduced and secured in a submerged downwardly open receiving space in a floating vessel, said outer buoyancy member having an at least partly upwardly tapering shape for mating with the receiving space, and an upwardly tapering lower surface, a central member rotatably mounted in said outer member, which central member is intended for anchoring to the sea bed and is arranged for passage of medium between a transfer line which, in operation, is coupled to the lower end of said central member and a tube system on the vessel, wherein said central member is provided with a lower extension body having an outer peripheral portion with an upwardly tapering upper surface abutting on and essentially corresponding to the upwardly tapering lower surface, of said outer buoyancy member, and having a lower portion which is downwardly tapering from said outer peripheral portion, said lower extension body comprising at least one buoyancy chamber for receiving buoyancy or ballast material.

2. A buoy according to claim 1, wherein said outer buoyancy member has an essentially circular peripheral shape and an at least partly upwardly tapering conical shape, and said lower portion of said extension body is downwardly conically tapering.

3. A buoy according to claim 1, wherein a number of fastening means for fastening upper ends of anchoring lines for anchoring of the buoy are fastened at intervals along the periphery of said outer peripheral portion of said lower extension body between said upwardly tapering upper surface and said downwardly tapering lower portion.

4. A buoy according to claim 2, wherein said outer buoyancy member at its lower end has an essentially axially extending extension portion extending between said adjacent conical portion of said outer member and said outer peripheral portion of said lower extension body.

5. A buoy according to claim 1 wherein said at least one buoyancy chamber is arranged to be able to be filled with or emptied of buoyancy or ballast material according to requirement.

6. A buoy according to claim 1 wherein said lower extension body is segmented, so as to form several watertight chambers.

7. A buoy according to claim 1, wherein said outer buoyancy member is provided with a fender means on at least an upper portion of its outer surface.

8. A buoy for use in loading or unloading of a flowable medium, especially oil, comprising an outer buoyancy member arranged to be introduced and secured in a submerged downwardly open receiving space in a floating vessel, said outer buoyancy member having an at least partly upwardly tapering shape for mating with the receiving space, with a fender means on at least an upper portion of its outer surface, said fender means consisting of a layer of elastic material, such as rubber, which is applied to said upper portion of said surface of said outer member, and a central member rotatably mounted in said outer member, which central member is intended for anchoring to the sea bed and is arranged for passage of medium between a transfer line which, in operation, is coupled to the lower end of said central member and a tube system on the vessel, wherein said central member is provided with a lower extension body having an outer peripheral portion abutting on and essentially corresponding to the outer periphery of an adjacent end of said outer buoyancy member, and having a lower portion which is downwardly tapering from said outer peripheral portion, said lower extension body comprising at least one buoyancy chamber for receiving buoyancy or ballast material.

9. A buoy for use in loading or unloading of a flowable medium, especially oil, comprising an outer buoyancy member arranged to be introduced and secured in a submerged downwardly open receiving space in a floating vessel, said outer buoyancy member having an at least partly upwardly tapering shape for mating with the receiving space, with a fender means on at least an upper portion of its outer surface, said fender means comprises a number of longitudinally extending guiding edge elements which are placed at intervals along the periphery of said surface of said outer member, and which are covered by a fender-forming material, and a central member rotatably mounted in said outer member, which central member is intended for anchoring to the sea bed and is arranged for passage of medium between a transfer line which, in operation, is coupled to the lower end of said central member and a tube system on the vessel, wherein said central member is provided with a lower extension body having an outer peripheral portion abutting on and essentially corresponding to the outer periphery of an adjacent end of said outer buoyancy member, and having a lower portion which is downwardly tapering from said outer peripheral portion, said lower extension body comprising at least one buoyancy chamber for receiving buoyancy or ballast material.

10. A buoy for use in loading or unloading of a flowable medium, especially oil, comprising an outer buoyancy member arranged to be introduced and secured in a submerged downwardly open receiving space in a floating vessel, said outer buoyancy member having an at least partly upwardly tapering shape for mating with the receiving space, and a central member rotatably mounted in said outer member, which central member is intended for anchoring to the sea bed and is arranged for passage of medium between a transfer line which, in operation, is coupled to the lower end of said central member and a tube system on the vessel, wherein said central member is provided with a lower extension body having an outer peripheral portion abutting on and essentially corresponding to the outer periphery of an adjacent end of said outer buoyancy member, and having a lower portion which is downwardly tapering from said outer peripheral portion, said lower extension body comprising at least one buoyancy chamber for receiving buoyancy or ballast material, a central replaceable bearing support member carrying a lower radial bearing and an upper axial bearing for supporting said central member, wherein said central member comprises upper and a lower hollow stem members which, at the transition to said lower extension body, are interconnected through a flange element which is arranged for support of said central member on said outer buoyancy member when said bearing support member is removed from the buoy.

* * * * *